US012624700B2

(12) United States Patent
Ekambaram et al.

(10) Patent No.: US 12,624,700 B2
(45) Date of Patent: May 12, 2026

(54) SUBMERSIBLE PUMP WITH STAGE EROSION CONTROL

(71) Applicant: Schlumberger Technology Corporation, Sugar Land, TX (US)

(72) Inventors: Raju Ekambaram, Singapore (SG); David Milton Eslinger, Bartlesville, OK (US); Kean Wee Cheah, Singapore (SG); Stanislav Ivanov, Singapore (SG); Teng Fei Wang, Singapore (SG); Arthur Ignatius Watson, Houston, TX (US); Jose Angel Caridad Urena, Singapore (SG)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/730,515

(22) PCT Filed: Apr. 26, 2023

(86) PCT No.: PCT/US2023/019934
§ 371 (c)(1),
(2) Date: Jul. 19, 2024

(87) PCT Pub. No.: WO2023/212024
PCT Pub. Date: Nov. 2, 2023

(65) Prior Publication Data

US 2025/0172148 A1 May 29, 2025

Related U.S. Application Data

(60) Provisional application No. 63/363,717, filed on Apr. 28, 2022.

(51) Int. Cl.
*F04D 13/08* (2006.01)
*F04D 1/06* (2006.01)
(Continued)

(52) U.S. Cl.
CPC ..... *F04D 13/086* (2013.01); *F04D 1/06* (2013.01); *F04D 13/10* (2013.01); *F04D 29/026* (2013.01); *F04D 29/445* (2013.01); *F04D 29/628* (2013.01)

(58) Field of Classification Search
CPC ..... F04D 13/086; F04D 1/06; F04D 13/10; F04D 29/026; F04D 29/445; F04D 29/628
See application file for complete search history.

(56) References Cited

U.S. PATENT DOCUMENTS 2,310,629 A 2/1943 Merwe
4,678,399 A * 7/1987 Vandevier ..... F04D 29/167 415/199.2

(Continued)

FOREIGN PATENT DOCUMENTS

WO 20180291907 A1 3/2021

OTHER PUBLICATIONS

Search Report and Written Opinion of International Patent Application No. PCT/US2023/019934 dated on Aug. 11, 2023, 11 Pages.

*Primary Examiner* — Dominick L Plakkoottam
(74) *Attorney, Agent, or Firm* — Kyle R. Miiller

(57) ABSTRACT

A technique facilitates long-term operation of a submersible pump which may be used in an electric submersible pumping system. According to an embodiment, the submersible pump comprises at least one stage, e.g. a plurality of stages. Each stage uses an impeller which may be rotated within a diffuser to establish a fluid flow through the pump. Additionally, each stage comprises an erosion control system positioned between the impeller and the diffuser to reduce erosion and/or the effects of erosion so as to extend the life of the submersible pump.

13 Claims, 5 Drawing Sheets

(51) Int. Cl.

| | |
|---|---|
| ***F04D 13/10*** | (2006.01) |
| ***F04D 29/02*** | (2006.01) |
| ***F04D 29/44*** | (2006.01) |
| ***F04D 29/62*** | (2006.01) |

(56) References Cited

U.S. PATENT DOCUMENTS

| | | | | |
|---|---|---|---|---|
| 4,781,531 | A * | 11/1988 | James | F04D 29/026 415/196 |
| 6,439,835 | B1 * | 8/2002 | Chien | F04D 29/628 415/214.1 |
| 11,377,939 | B1 * | 7/2022 | Ye | E21B 43/128 |
| 2005/0074330 | A1 * | 4/2005 | Watson | F04D 29/2227 415/199.2 |
| 2009/0039722 | A1 * | 2/2009 | Cain | H02K 5/128 310/90 |
| 2010/0319926 | A1 | 12/2010 | Reid | |
| 2012/0257985 | A1 * | 10/2012 | Parmeter | F04D 13/10 417/53 |
| 2013/0017075 | A1 | 1/2013 | Orban | |
| 2014/0196795 | A1 * | 7/2014 | Dunning | F04F 5/00 137/15.08 |
| 2015/0125279 | A1 | 5/2015 | McCluskey | |
| 2017/0122333 | A1 | 5/2017 | Gray et al. | |
| 2017/0248159 | A1 * | 8/2017 | Rao | F04D 29/669 |
| 2017/0350399 | A1 * | 12/2017 | Eslinger | F04D 29/426 |
| 2018/0291907 | A1 * | 10/2018 | Ye | F04D 13/10 |
| 2019/0085667 | A1 * | 3/2019 | Xiao | F04D 1/066 |
| 2020/0116152 | A1 * | 4/2020 | Smith | F04D 1/06 |
| 2021/0048029 | A1 * | 2/2021 | Ye | F04D 29/0473 |
| 2022/0056919 | A1 * | 2/2022 | Sheth | F04D 1/00 |

* cited by examiner

SUBMERSIBLE PUMP WITH STAGE EROSION CONTROL

BACKGROUND

This application is a national stage entry under 35 U.S.C. 371 of International Application No. PCT/US2023/019934, entitled "SUBMERSIBLE PUMP WITH STAGE EROSION CONTROL," filed Apr. 26, 2023, which claims the benefit of U.S. Provisional Application No. 63/363,717, entitled "SUBMERSIBLE PUMP WITH STAGE EROSION CONTROL," filed Apr. 28, 2022, the disclosure of which is hereby incorporated herein by reference.

In hydrocarbon well applications, electric submersible pumping systems often are used to pump fluid such as hydrocarbon-based fluids. The electric submersible pumping system may be conveyed downhole and used to pump oil from a downhole wellbore location to a surface collection location along a fluid flow path. In a variety of applications, the electric submersible pumping system employs a submersible, centrifugal pump having a plurality of stages with each stage comprising an impeller and a diffuser. The impeller rotates relative to the diffuser and forces fluid to the next sequential stage and ultimately out of the pump for production to, for example, a surface collection location. In many environments, the produced fluid may contain sand which impacts against pump components during the pumping operation. The sand can create unwanted erosion of pump components and may ultimately lead to pump failure.

SUMMARY

In general, a system and methodology facilitate long-term operation of a submersible pump which may be used in an electric submersible pumping system. According to an embodiment, the submersible pump comprises at least one stage, e.g. a plurality of stages. Each stage uses an impeller which may be rotated within a diffuser to establish a fluid flow through the pump. Additionally, each stage comprises an erosion control system positioned between the impeller and the diffuser to reduce erosion and/or effects of the erosion so as to extend the life of the submersible pump.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate long-term operation of a submersible pump which may be used in an electric submersible pumping system. As described herein, various erosion reducing features used alone or in combination are able to improve the erosion resistance of a given pump stage, thus helping extend pump reliability. Many of the features focus on improving erosion resistance of susceptible zones, thus saving cost relative to the expense of addressing the entire part. By way of example, the features may be selected and designed with a focus on the diffuser break water zone (i.e. the zone where flow exiting the impeller directly impacts a wall of the diffuser); flow swirl zone; and other close running zones between impeller and diffuser which are prone to erosion. Examples of the latter zones include the close running front seal zone and balance ring zone.

According to an embodiment, the submersible pump comprises at least one stage. In many embodiments, the submersible pump comprises a plurality of stages sequentially aligned to provide better pumping performance. Each stage uses an impeller which may be rotated within a diffuser to establish a fluid flow through the pump. Additionally, each stage comprises an erosion control system positioned between the impeller and the diffuser to reduce erosion and/or effects of the erosion so as to extend the life of the submersible pump.

Figure 1:
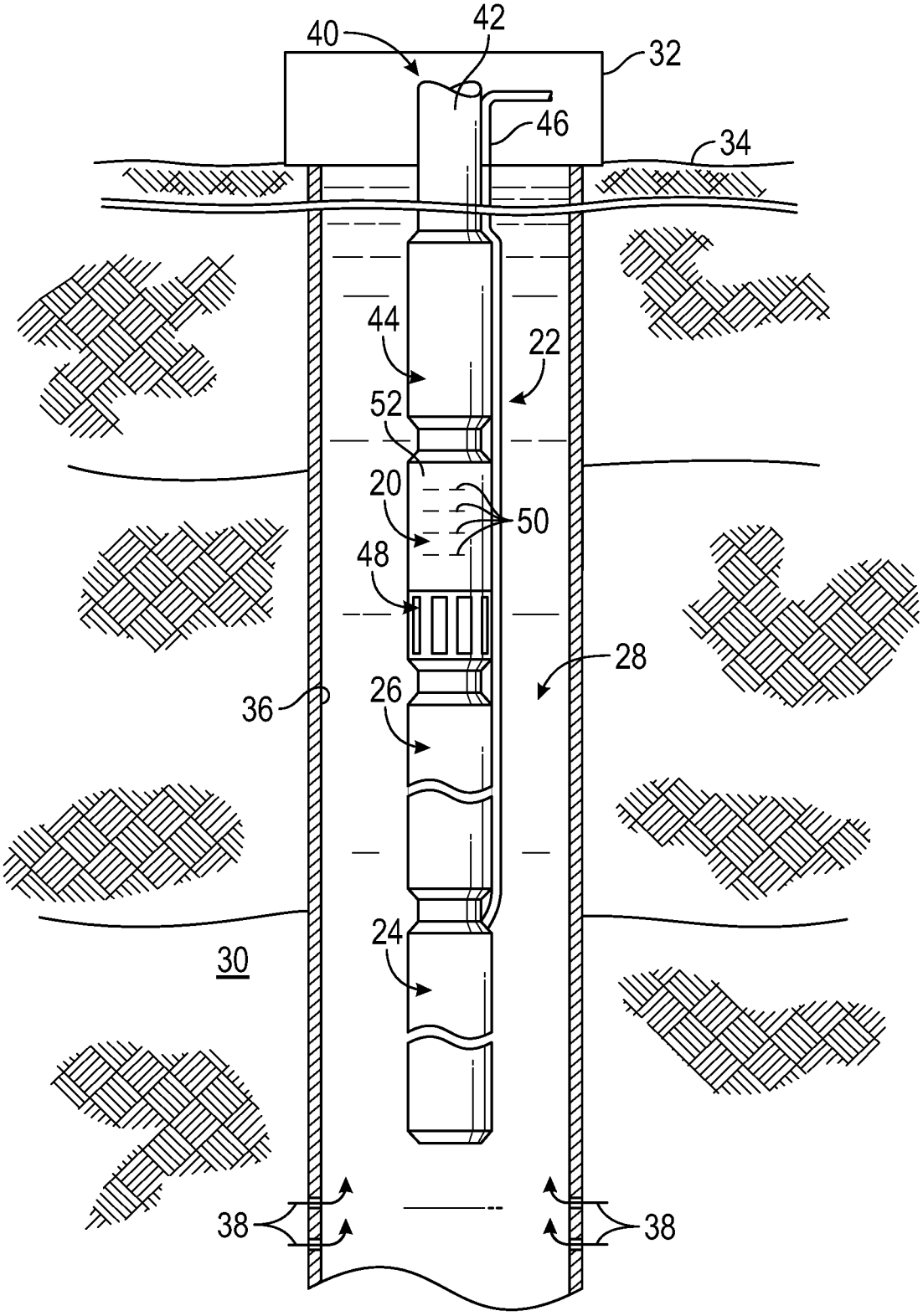
FIG. 1 is a schematic illustration of an example of a submersible pump positioned in an electric submersible pumping system, according to an embodiment of the disclosure.

Referring generally to FIG. 1, an example of a submersible pump 20, e.g. a submersible, centrifugal pump, is illustrated as deployed in an electric submersible pumping system 22. The illustrated embodiment is provided as an example, but numerous types, sizes, and arrangements of pumping systems 22 may be used in a variety of well related applications. By way of example, the electric submersible pumping system 22 may comprise at least one submersible motor 24 which is used to power the submersible pump 20. The pumping system 22 also may comprise a motor protector 26 which enables pressure balancing of the internal motor fluid of submersible motor 24 with respect to the surrounding environment. The submersible pump 20, submersible motor 24, and motor protector 26 are coupled together into electric submersible pumping system 22 in a manner which allows the submersible motor 24 to drive the submersible pump 20 during a downhole pumping operation.

In this example, the electric submersible pumping system 22 is deployed downhole in a wellbore 28 drilled into a formation 30 containing desirable production fluid, e.g. oil and/or other hydrocarbon-based fluids. As illustrated, the wellbore 28 extends downwardly from a wellhead 32 positioned at a surface location 34. In some applications, the wellbore 28 may be lined with a wellbore casing 36 which, in turn, may be perforated with a plurality of perforations 38. The perforations 38 extend through casing 36 and out into the surrounding formation 30. Accordingly, the perforations 38 facilitate the flow of fluids between the surrounding formation 30 and the wellbore 28.

The electric submersible pumping system 22 may be conveyed down into wellbore 28 via a suitable conveyance 40 which may be in the form of a tubing 42, e.g. coiled tubing or production tubing. However, other conveyances such as wireline or slick line also may be used to deploy submersible pumping system 22. Various types of connectors 44 may be used to couple the pumping system 22 with the conveyance 40.

Electric power is provided to submersible motor 24 by, for example, a power cable 46 routed downhole along conveyance 40 and submersible pumping system 22. When powered, the submersible motor 24 is able to drive submersible pump 20 which then draws in well fluid from wellbore 28 through a suitable pump intake 48. The well fluid is then moved (pumped) up through the submersible pump 20 and discharged into the interior of conveyance 40 (or to another suitable flow route) through which it flows to the surface.

By way of example, submersible pump 20 may comprise a plurality of pump stages 50. The pump stages 50 may be arranged sequentially along the interior of a pump housing 52. As described in greater detail below, each stage 50 comprises an impeller which is rotated within a diffuser to move/pump the fluid along submersible pump 20. The impellers may be mounted along a pump shaft which is rotated via submersible motor 24.

Figure 2:
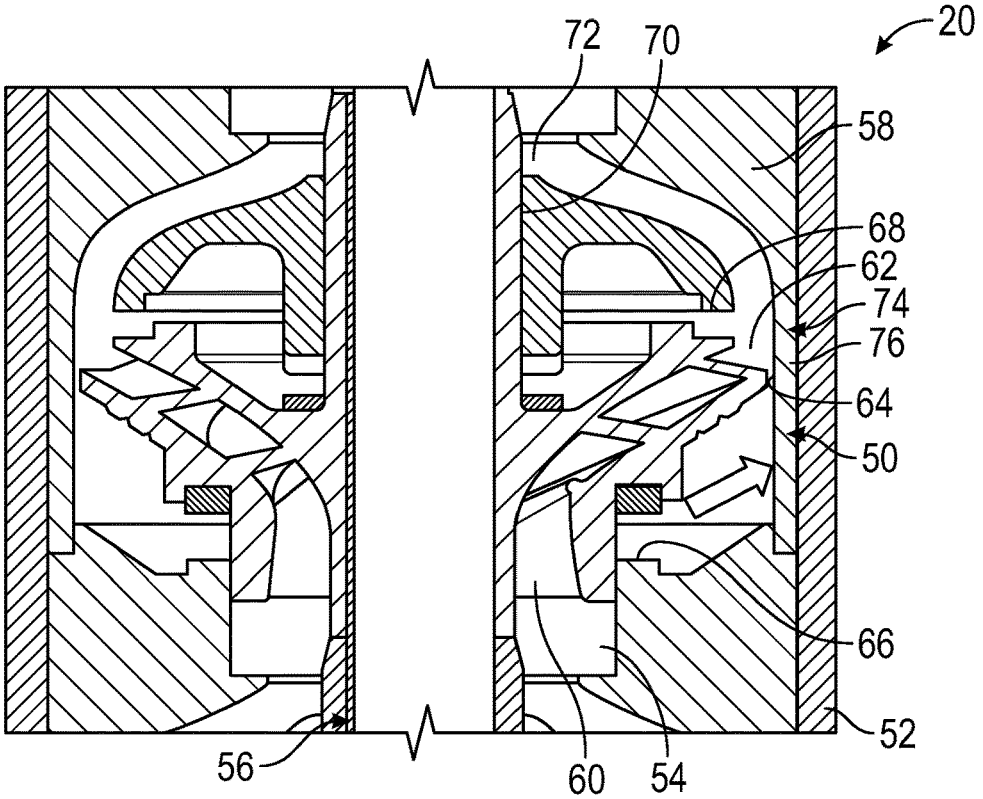
FIG. 2 is a cross-sectional illustration of an example of a stage of the submersible pump which includes an erosion control system positioned between an impeller and a diffuser, according to an embodiment of the disclosure.

Referring generally to FIG. 2, an embodiment of one of the pump stages 50 is illustrated. In this example, pump stage 50 comprises an impeller 54 which is rotatable via a shaft 56 relative to a corresponding diffuser 58. During rotation of impeller 54, a well fluid is drawn up through impeller passages 60 and discharged to a break water zone 62 of diffuser 58. The diffuser break water zone 62 is the zone where fluid flow exiting the impeller 54 impacts an impact wall 64 of diffuser 58, thus making the impact wall 64 susceptible to erosion. Other areas of interaction between impeller 54 and diffuser 58 which also are susceptible to erosion include a front seal region 66, a balance ring region 68, a hub region 70, and a diffuser exit flow region 72.

In the embodiment illustrated, the stage 50 also comprises an erosion control system 74 positioned between the impeller 54 and the diffuser 58 in, for example, one or more of the regions susceptible to erosion. The erosion control system 74 is constructed and located so as to extend the life of the submersible pump 20 and thus of the overall electric submersible pumping system 22. Referring again to FIG. 2, this embodiment of the erosion control system 74 includes a thick wall section 76 located along impact wall 64 at the diffuser break water zone 62. The thick wall section 76 may be generally thicker than the other wall sections, e.g. adjacent wall sections, forming diffuser 58. The thick wall section 76 is able to improve the reliability of stage 50 by extending the time required for sand or other abrasives to erode the wall thickness to a degree causing structural or operational problems.

Figure 3:
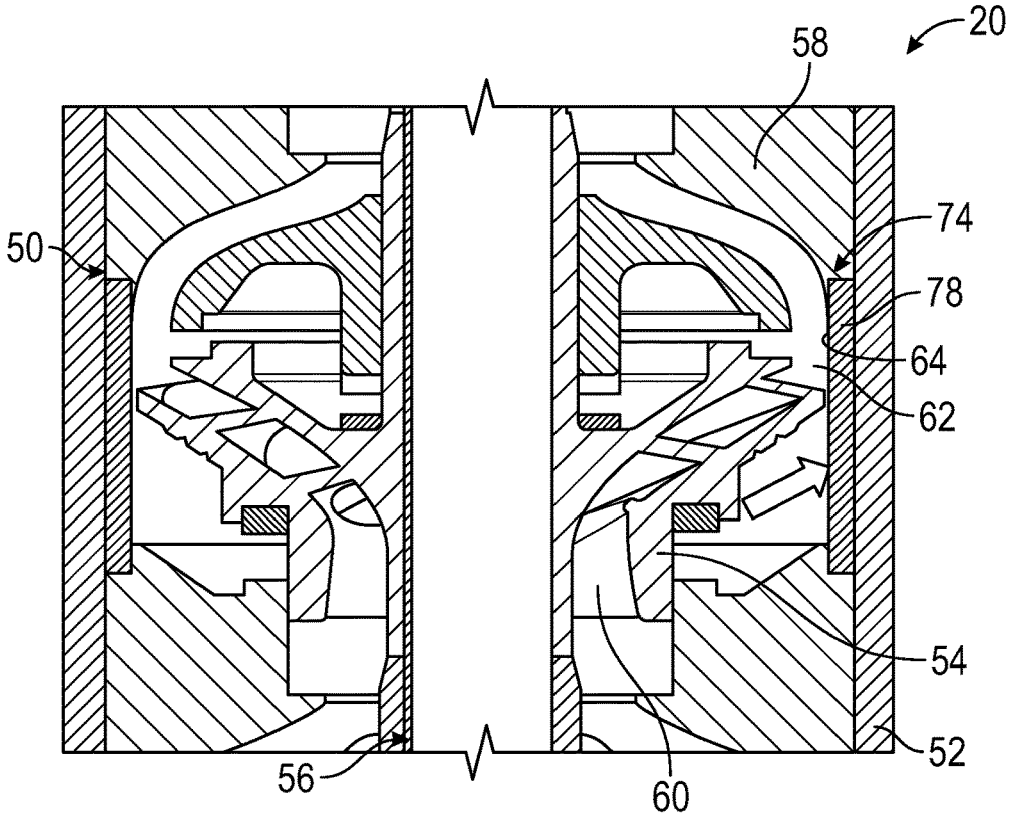
FIG. 3 is a cross-sectional illustration of an example of a stage of the submersible pump which includes another type of erosion control system positioned between an impeller and a diffuser, according to an embodiment of the disclosure.

In some configurations, the erosion control system 74 includes a hardened section, for example along impact wall 64 at the diffuser break water zone 62. The hardened section can include a hard coating, such as flame-sprayed tungsten carbide, or can be made of a harder material than a remainder of the diffuser 58. The hard coating can be relatively thick to avoid being quickly worn through. Referring generally to FIG. 3, another embodiment of the erosion control system 74 is illustrated as comprising an insert or spacer 78 located at impact wall 64 of the diffuser break water zone 62. The insert 78 may be formed of a harder material which is selected to substantially improve erosion resistance at the diffuser impact wall 64 of break water zone 62. By way of example, the insert 78 may be formed from a hard material, such as a ceramic material or a hardened metal material, e.g. a hardened steel material. The harder material is harder than the material used to form the main body of diffuser 58, e.g. harder than the diffuser material adjacent insert 78, and thus more resistant to erosion. As shown, a tubular lower portion of the diffuser 58 can be replaced by the insert 78. The insert 78 can have a tubular shape. In some configurations, the insert 78 is made of centrifugally cast white iron, ceramic, or cermet.

Figure 4:
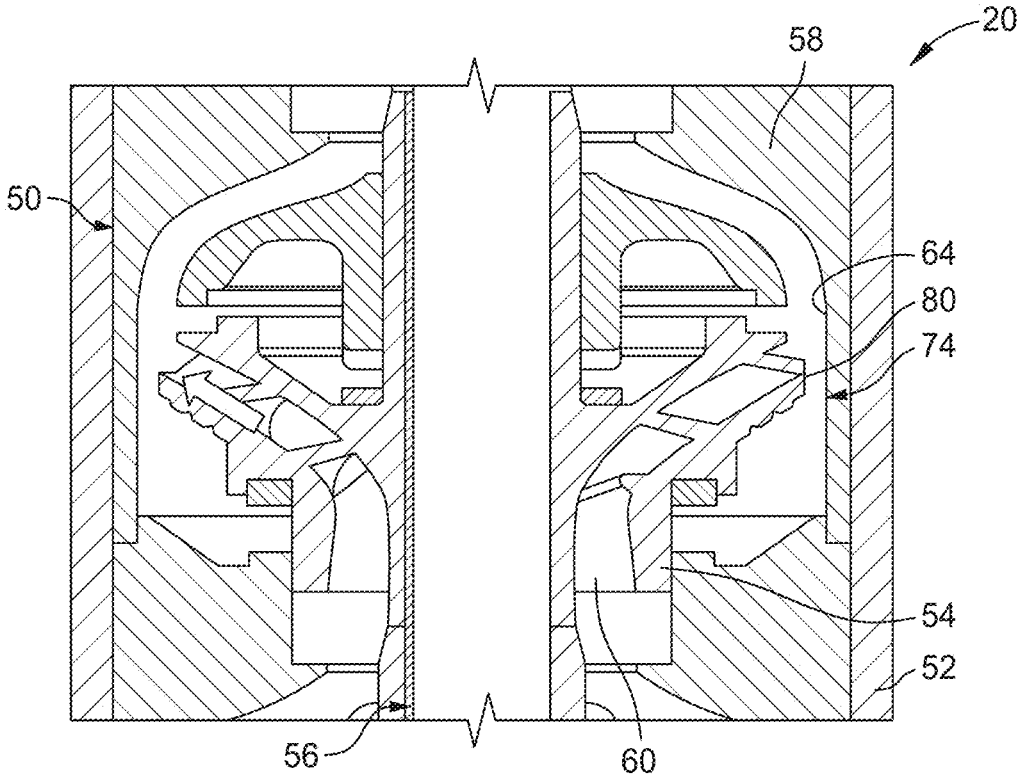
FIG. 4 is a cross-sectional illustration of an example of a stage of the submersible pump which includes another type of erosion control system positioned between an impeller and a diffuser, according to an embodiment of the disclosure.

Referring generally to FIG. 4, another embodiment of the erosion control system 74 is illustrated. In this example, the impeller 54 is constructed with a truncated impeller tip 80 at the largest diameter portion of impeller 54. Effectively, this reduces the diameter of impeller 54 proximate the diffuser break water zone 62 which, in turn, can reduce the impact and erosive effect of sand striking the diffuser impact wall 64 at zone 62.

It should be noted the truncated impeller tip 80 may be in the form of a truncated portion of the tip. For example, the impeller 54 may be formed with vanes mounted to a shroud and a portion of the vane/shroud tip may be truncated. According to one embodiment, the truncated impeller tip 80 may be formed with a truncated/reduced impeller vane tip but with a standard outside diameter shroud tip. This latter type of configuration also can reduce erosive effects by reducing the convection of high swirl flow from the impeller tip into the front cavity (which is the cavity directly below the truncated tip in FIG. 4). Reducing the convection of high swirl flow effectively reduces erosion of the front cavity walls.

Figure 5:
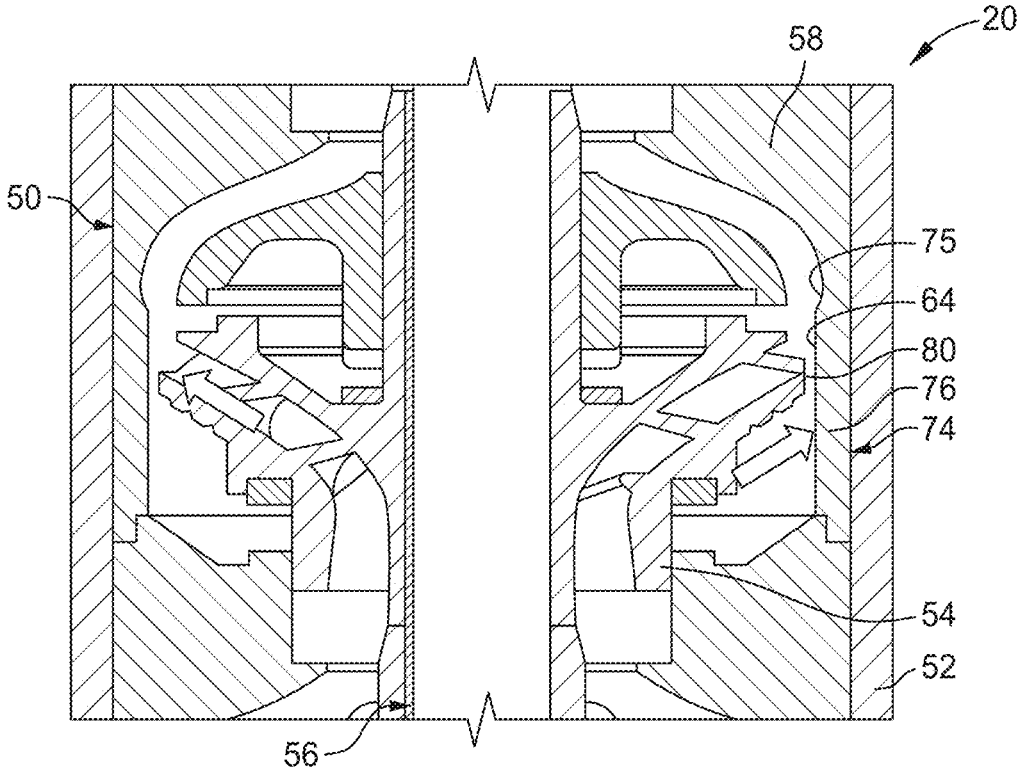
FIG. 5 is a cross-sectional illustration of an example of a stage of the submersible pump which includes another type of erosion control system positioned between an impeller and a diffuser, according to an embodiment of the disclosure.

In some embodiments, the use of truncated impeller tip 80 provides additional room for utilizing thick wall section 76, as illustrated in FIG. 5. The thick wall section 76 has a first thickness, and is coupled by an inclined transition section 75 to a wall of the diffuser 58 having a smaller second thickness. The thick wall section 76 may further enhance protection against deleterious effects of erosion when combined with truncated impeller tip 80. It should be noted the truncated impeller tip 80 also may be combined with inserts 78 positioned along impact wall 64 at break water zone 62. The inserts 78 may be constructed with a material and thickness able to improve reliability of stage 50 in terms of erosion resistance.

Figure 6:
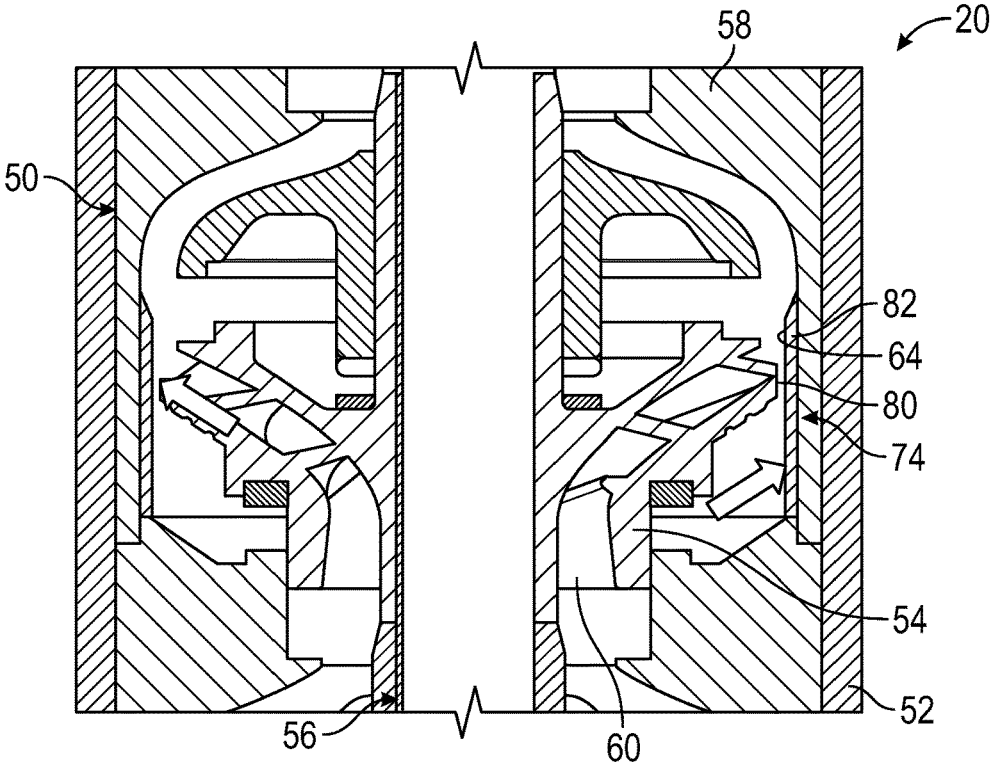
FIG. 6 is a cross-sectional illustration of an example of a stage of the submersible pump which includes another type of erosion control system positioned between an impeller and a diffuser, according to an embodiment of the disclosure.

According to some embodiments, the truncated impeller tip 80 may be combined with a wall coating 82 located at impact wall 64 of break water zone 62, as illustrated in FIG. 6. In other words, the diffuser impact wall 64 may be coated, e.g. cladded, along its interior diameter with hard materials which are less susceptible to erosion. An example of a hard coating material is tungsten carbide which provides substantial erosion protection against abrasive sand which may be contained in the fluid flowing through submersible pump 20. The wall coating 82 may be used with or without truncated impeller tip 80 to reduce the effects of erosion.

Figure 7:
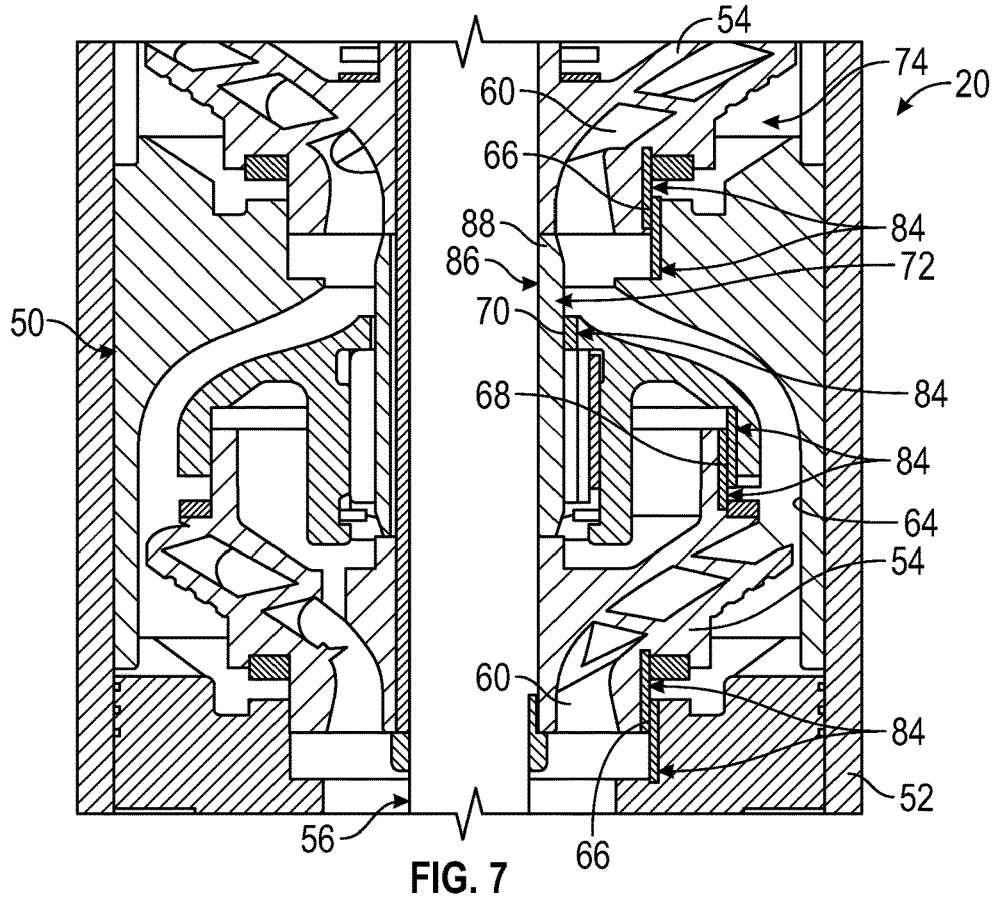
FIG. 7 is a cross-sectional illustration of an example of a stage of the submersible pump which includes another type of erosion control system positioned between an impeller and a diffuser, according to an embodiment of the disclosure.

Referring generally to FIG. 7, another embodiment of the erosion control system 74 is illustrated. In this example, protective layers 84 may be used at zones susceptible to erosion, such as at the close running front seal regions 66, balance ring region 68, and hub region 70. By way of example, the protective layers 84 may be formed as inserts and/or coatings formed of harder materials, e.g. tungsten carbide, which are less susceptible to erosion. If the protective layers 84 are formed as inserts, the inserts may be secured in place using suitable locking mechanisms such as press fits, welding, adhesives, or other locking mechanisms.

As further illustrated in FIG. 7, the diffuser exit flow region 72 may be protected via a sleeve 86 having an extended end 88 which extends into the diffuser exit flow region 72 generally along the exterior of shaft 56. The sleeve 86 may be formed of tungsten carbide or another suitably hard material which provides protection in the diffuser exit flow region 72 (which would otherwise be susceptible to erosion). It should be noted the sleeve 86 may be constructed as a diffuser spacer to replace a portion of the corresponding impeller 54.

Figure 8:
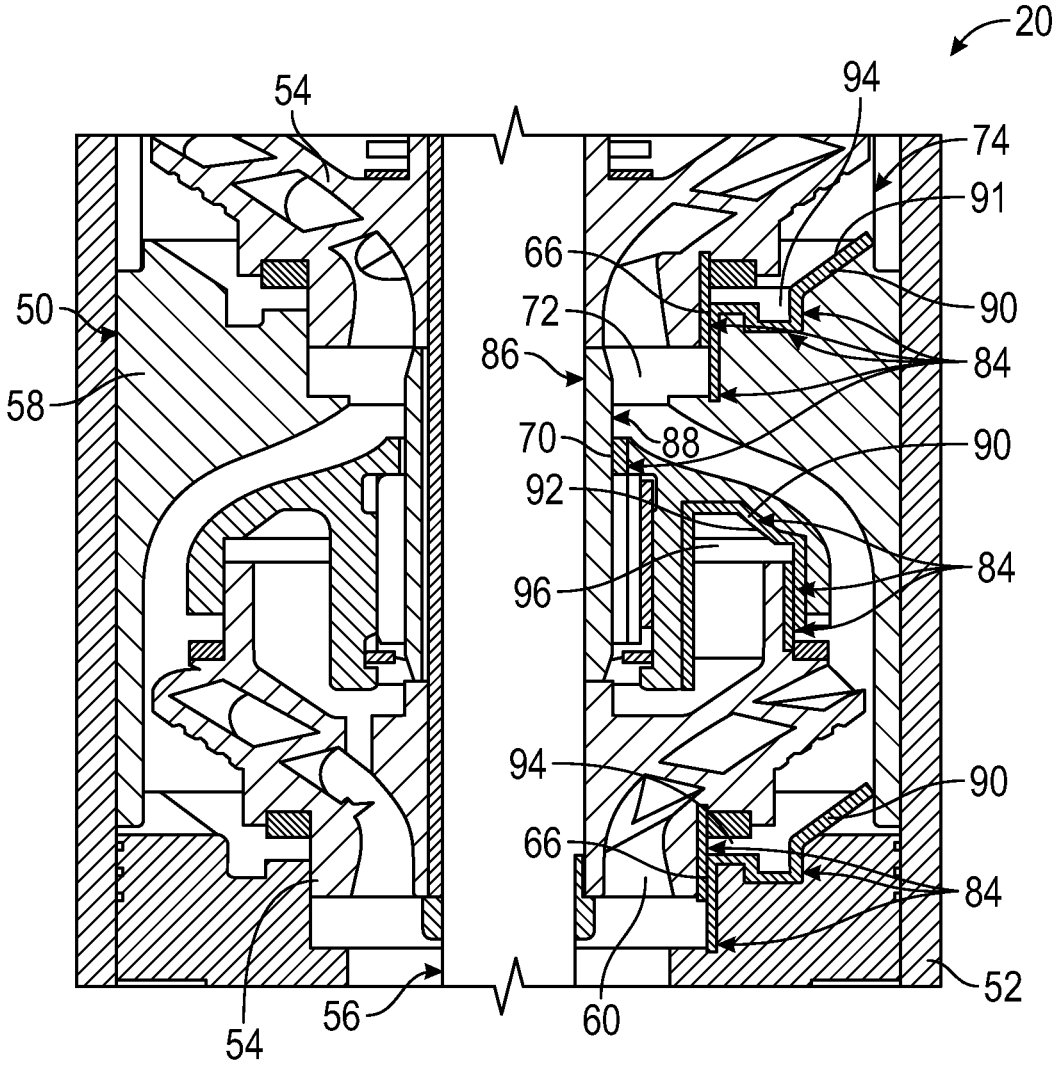
FIG. 8 is a cross-sectional illustration of an example of a stage of the submersible pump which includes another type of erosion control system positioned between an impeller and a diffuser, according to an embodiment of the disclosure.

In some embodiments, the protective layers 84 may be in the form of a hard surface coatings 90 extended to additional zones susceptible to erosion. For example, the protective coatings 90 may be extended into a flow swirl zone or zones 92, as illustrated in FIG. 8. The flow swirl zones 92 may occur at, for example, a front seal cavity 94 and a balance ring cavity 96 (see FIG. 8). The various protective layers 84 may be formed of coatings and/or inserts arranged in various combinations as desired for a given environment and use of electric submersible pumping system 22.

Depending on the parameters of a given application and/or environment, the structure of submersible pump 20 and/or electric submersible pumping system 22 may be adjusted. For example, the submersible pumping system 22 may be in the form of an electric submersible pumping system combined with other components for use in a wellbore or other type of borehole. Similarly, the pump stages 50 of the submersible pump 20 may comprise various impellers and diffusers as well as other components with desired configurations and features to accommodate the parameters of a given operation. The erosion protection system 74 may be constructed with various individual features or combinations of features described herein to provide a suitable level of protection against erosion for a given downhole application.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

an electric submersible pumping system having:

a submersible motor;

a motor protector; and a submersible pump powered by the submersible motor, the submersible pump comprising a housing containing a plurality of stages arranged to pump well fluid, each stage having an impeller that is configured to discharge the well fluid into a corresponding diffuser, the impeller being mounted on a shaft and being rotatable relative to the diffuser, each stage further comprising an erosion control system positioned between the impeller and the diffuser to extend the life of the submersible pump, wherein the erosion control system includes:

an impact wall, the impact wall having a constant distance from a centerline of the submersible pump, the impact wall including a first thickness extending along an inner surface of the housing and coupled by an inclined transition section to a wall of the diffuser downstream of the impact wall, the wall having a second thickness smaller than the first thickness, such that an undeviated fluid flow discharged from the impeller directly impacts the impact wall; and a tubular protective sleeve disposed radially between the shaft and the diffuser, wherein the tubular protective sleeve axially abuts a first impeller of a first stage and a second impeller of a second stage, and wherein the tubular protective sleeve extends into a diffuser exit flow region.

2. The system as recited in claim 1, wherein the erosion control system is located at least in part in a break water zone of the diffuser where the well fluid exits the impeller and impacts the impact wall.

3. The system as recited in claim 1, further comprising a truncated impeller tip which reduces the outside diameter of the impeller.

4. The system of claim 1, wherein an end of the impact wall at least partially defines an upstream end of the diffuser.

5. A method, comprising:

assembling an electric submersible pumping system having a submersible motor, a motor protector, and a submersible pump powered by the submersible motor;

providing the submersible pump with a housing containing a plurality of stages arranged to pump well fluid, each stage having an impeller that discharges the well fluid into a corresponding diffuser, the impeller being mounted on a shaft and rotatable relative to the diffuser; and protecting each stage of the plurality of stages with an erosion control system positioned between the impeller and the diffuser to extend the life of the submersible pump, wherein the erosion control system includes:

an impact wall, the impact wall having a constant distance from a centerline of the submersible pump, the impact wall including a first thickness extending along an inner surface of the housing and coupled by an inclined transition section to a wall of the diffuser downstream of the impact wall, the wall having a second thickness smaller than the first thickness, such that an undeviated fluid flow exiting the impeller directly impacts the impact wall; and a tubular protective sleeve disposed radially between the shaft and the diffuser, wherein the tubular protective sleeve axially abuts a first impeller of a first stage and a second impeller of a second stage, and wherein the tubular protective sleeve extends into a diffuser exit flow region.

6. The method as recited in claim 5, further comprising positioning the erosion control system at least in part in a break water zone of the diffuser where the well fluid exits the impeller and impacts the impact wall.

7. The method as recited in claim 5, further comprising forming the erosion control system by truncating at least a portion of an impeller tip of the impeller.

8. The method of claim 5, wherein an end of the impact wall at least partially defines an upstream end of the diffuser.

9. An electric submersible pump comprising:

a housing containing a plurality of stages, each stage comprising:

an impeller; and a diffuser, wherein the impeller is disposed about a shaft and is configured to rotate relative to the diffuser, and wherein at least one of the plurality of stages comprises a tubular spacer disposed along an inner surface of the housing axially between consecutive diffusers, the tubular spacer including an inner surface a constant distance from a centerline of the electric submersible pump at a location where an undeviated fluid flow discharged from the impeller directly impacts the tubular spacer, a hardness of the tubular spacer is greater than a hardness of the diffuser; and a tubular protective sleeve disposed radially between the shaft and the diffuser, wherein the tubular protective sleeve axially abuts a first impeller of a first stage and a second impeller of a second stage, and wherein the tubular protective sleeve extends into a diffuser exit flow region.

10. The pump of claim 9, wherein the spacer comprises white iron.

11. The pump of claim 9, wherein the spacer comprises ceramic or cermet.

12. The pump of claim 9, wherein the spacer replaces a lower tubular portion of an upper diffuser of the consecutive diffusers.

13. The pump of claim 9, wherein an end of the tubular spacer at least partially defines an upstream end of a stage of the plurality of stages.

* * * * *